US005421242A

United States Patent [19]

Bächli et al.

[11] Patent Number: 5,421,242

[45] Date of Patent: Jun. 6, 1995

[54] MEMBRANE ARRANGEMENT FOR A PRESSURE SWITCH OR FOR A PRESSURE-RESPONSIVE TRANSMITTER AND PROCESS AND APPARATUS FOR ASSEMBLING THE ARRANGEMENT

[75] Inventors: Rolf Bächli, Würenlos, Switzerland; Jürgen Budde, Horheim, Germany

[73] Assignee: Huba Control Ag, Wurenlos, Switzerland

[21] Appl. No.: 143,116

[22] Filed: Oct. 29, 1993

[30] Foreign Application Priority Data

Oct. 30, 1992 [CH] Switzerland ..... 03387/92

[51] Int. Cl.[6] ..... F01B 19/00

[52] U.S. Cl. ..... 92/93; 92/98 R; 92/99

[58] Field of Search ..... 92/98 R, 97, 100, 101, 92/102, 103 R, 103 F, 103 SD, 93; 200/302.2, 83 R, 83 B

[56] References Cited

U.S. PATENT DOCUMENTS 3,168,855 2/1965 Randol ..... 92/100
3,212,446 10/1965 Golden et al. ..... 92/99
4,663,974 5/1987 Scherer .
4,767,898 8/1988 Yasuda et al. .
5,216,213 6/1993 Sato ..... 200/83 R
5,249,508 10/1993 Hasegawa et al. ..... 92/105

FOREIGN PATENT DOCUMENTS 86261 5/1921 Austria ..... 92/99
0017453 10/1980 European Pat. Off. .
0507002 10/1992 European Pat. Off. .

*Primary Examiner*—Thomas E. Denion
*Attorney, Agent, or Firm*—Cushman, Darby & Cushman

[57] ABSTRACT

A membrane supporting plate (10) includes on its outer rim (20) an axially directed ring groove (30), into which an annular membrane (22) is inserted, free from distortion, by its clamping boss (28) disposed on its inner rim. A beaded rim (32) disposed next to the ring groove (30) on the membrane supporting plate (10) is deformed radially outwards by a beading process. As a result of the effected sealing of the ring groove (30), the membrane (22), which is made from highly elastic material, is anchored pressure-tight and free from distortion to the membrane supporting plate (10).

4 Claims, 2 Drawing Sheets

MEMBRANE ARRANGEMENT FOR A PRESSURE SWITCH OR FOR A PRESSURE-RESPONSIVE TRANSMITTER AND PROCESS AND APPARATUS FOR ASSEMBLING THE ARRANGEMENT

BACKGROUND OF THE INVENTION

The invention relates to a membrane arrangement for a pressure switch or for a pressure-responsive transmitter and to a process for connecting the membrane to a membrane supporting plate. The invention also relates to an apparatus for assembling the arrangement.

In the high-precision pressure field, for example, in gas-fired heating boilers, switching accuracies of a few Pascals are required for the monitoring of waste gases. Such accuracies can not be ensured by pressure switches of known construction. Operating pressure adjustments in the order of magnitude of less than 200 Pa or pressure differentials of less than 20 Pa are generally involved in these applications.

Pressure regulators and pressure switches for very small pressure differentials in the high-precision pressure field generally require relatively large-surface membranes offering extremely low friction resistances. Very thin membranes made from highly elastic material are especially suitable for use in high precision pressure measuring. In order to ensure the necessary stability of such membranes and to transmit the energy provided by the pressure differential to a switching or transmitter mechanism, it is commonly known to support such a membrane with a membrane supporting plate consisting of a relatively stiff material.

In order to reduce material and weight, it is advantageous to form the membrane in an annular configuration, so that it joins radially onto the membrane supporting plate without spanning the entire surface area thereof. However, the handling the storage of full-surface membrane require special care before installation. In contrast, annular membranes are substantially less sensitive, so that they can be treated harmlessly, like bulk material. As a result of such a simplification, lower production costs are obtained.

In a known arrangement, an annular membrane is fastened to a membrane supporting plate in a radially disposed groove. In this case, the membrane supporting plate is injected onto the membrane.

SUMMARY OF THE INVENTION

The object of the invention is to provide a membrane arrangement in which an annular membrane is mechanically fastened, free from distortion and pressure-tight, to a membrane supporting plate. This objective is accomplished by providing a pressure responsive pressure arrangement including an annular membrane supporting plate having a beaded rim and a grove, and an annular membrane including an inner rim, the inner rim engaging the groove of the membrane supporting plate. The beaded rim contacts the inner rim so that the membrane is fastened in a distortion free manner to the support plate so as to ensure a pressure-tight connection between the membrane and the support plate. In addition, a method for the efficient interconnection of the two parts and an apparatus for assembling the arrangement is also disclosed.

In accordance with the principles of the invention, optional materials can be combined with one another for the membrane and the membrane supporting plate, including materials which are not generally suitable for being glued, welded or injected onto one another, such as plastics.

In contrast to an arrangement having a full-surface membrane resting on a membrane supporting plate, pressurization in both directions is possible without the membrane lighting-off from the membrane supporting plate. The annular configuration also reduces cost, in comparison to a full-surface membrane of relatively expensive material, such as silicone gum, for example. In addition, such an arrangement permits very precise pressure detection at very low pressures, approaching zero.

In one embodiment, the membrane, for connection to the membrane supporting plate, is ensured to be able to be inserted without expansion and hence free from distortion, by its clamping boss disposed on the inner rim, into the groove disposed on the outer rim of the membrane supporting plate.

In another embodiment, the membrane can be anchored reliably and pressure-tight by its inner clamping boss in the groove of the membrane supporting plate without the clamping boss being deformed and the membrane distorted, since the groove is merely sealed by the beaded rim, yet is not altered in its extent.

A further embodiment of the invention serves to lend the membrane supporting plate the necessary stiffness combined with the lowest possible weight.

The method of assembling the arrangement according the invention is suitable both for a plastics membrane supporting plate and for a metal one, one made from die-casting, for example.

A preferred embodiment of the assembly method provides an efficient connection of the membrane to a plastics membrane supporting plate. As in the case of a metal membrane supporting plate, this connection essentially involves a mechanical connection, in the creation of which, no solvent vapors are to be expected, as can occur with gluing and, where appropriate, when one part is injected onto the respective other part or the two parts are welded together.

The invention also provides an apparatus for connecting the membrane to a plastics membrane supporting plate.

DETAILED DESCRIPTION OF THE PRESENTLY PREFERRED EXEMPLARY EMBODIMENTS

Figure 1:
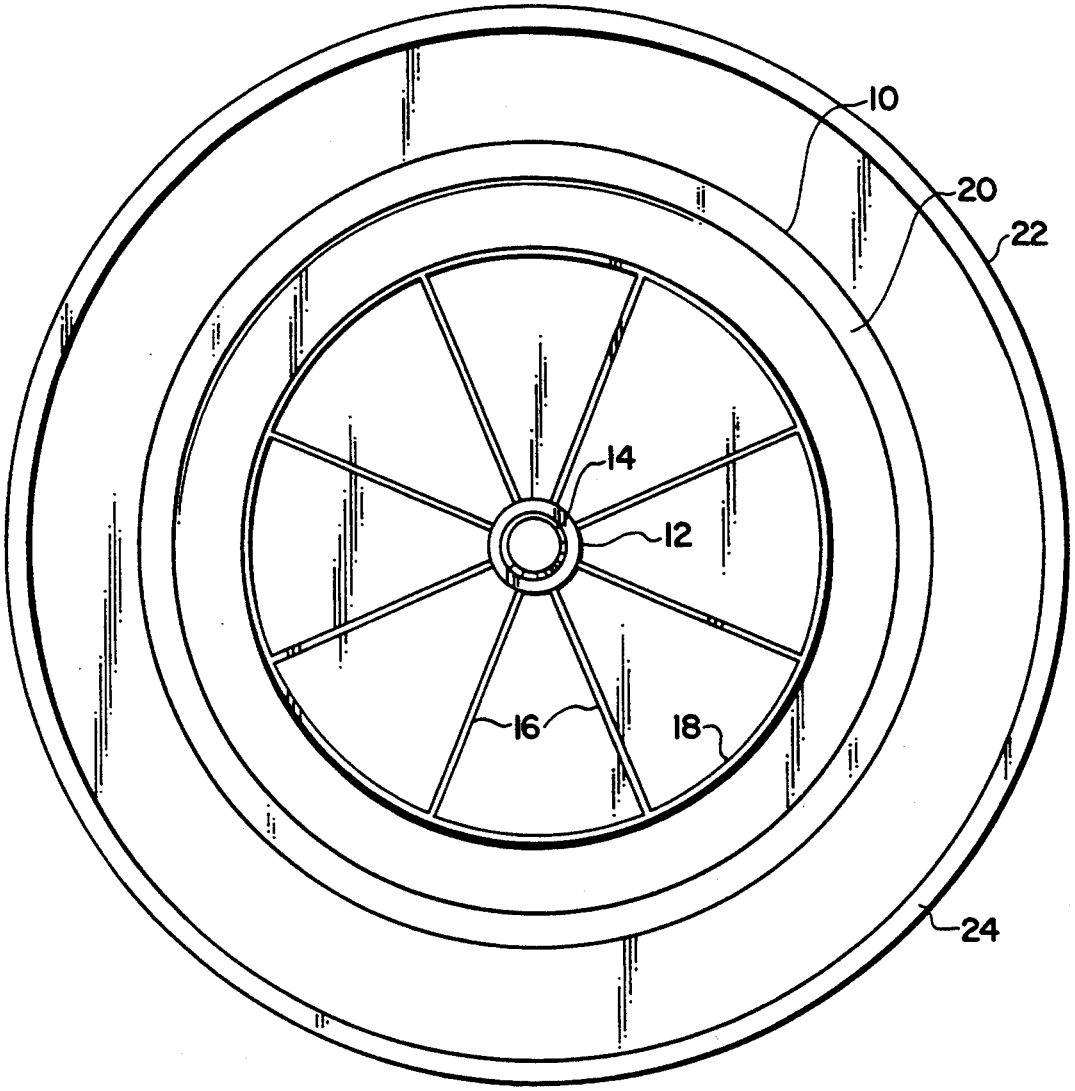
FIG. 1 shows a plan view of a membrane disposed onto a membrane supporting plate.

The membrane supporting plate 10, preferably made of plastics and represented in FIG. 1 exhibits in its center, a hub 12 and a ram 14. From the hub 12, eight reinforcing ribs 16 extend in star-shaped configuration, in the radial direction, to a circular ribbed rim 18. Fastened to the outer rim 20 of the membrane supporting plate 10 is an annular membrane 22. The annular membrane 22 includes on its outer rim, an outer clamping boss 24 designed for clamping into a pressure switch or pressure transmitter housing (not shown).

Figure 2:
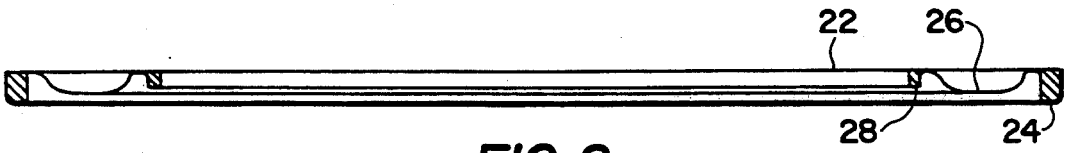
FIG. 2 shows a sectional view of the membrane of FIG. 1.

As shown in FIG. 2, the annular membrane 22 exhibits a very thin-walled crimp 26, which extends in the radial direction in an annular shape between the outer clamping boss 24 and an inner clamping boss 28.

Figure 3:
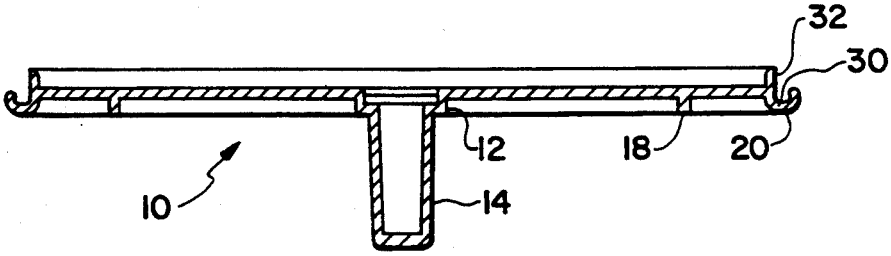
FIG. 3 shows a sectional view of the membrane supporting plate of FIG. 1.

As illustrated in FIG. 3, the membrane supporting plate 10 exhibits, in its outer rim 20, an axially directed ring groove 30, the diameter of which corresponds to that of the inner clamping boss 28 of the membrane 22, so that the inner clamping boss 28 fits into the ring groove 30. On the inner side of the ring groove 30, there extends in the axial direction a likewise annular beaded rim 32. This serves to seal the ring groove 30 once the membrane 22 has been inserted by its inner clamping boss 28 into the ring groove 30.

Figures 4, 5:
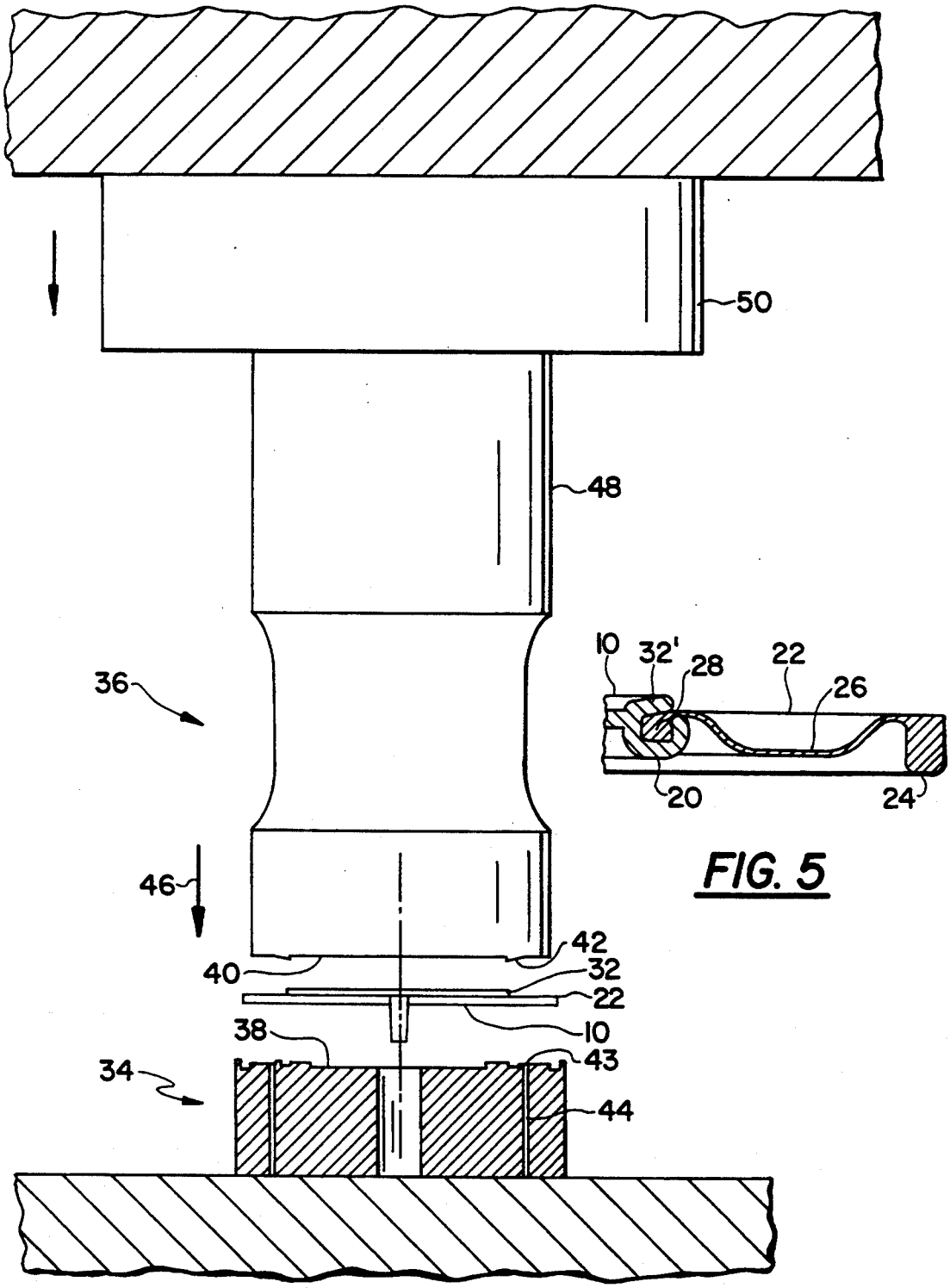
FIG. 4 shows an apparatus provided in accordance with the principles of the invention for connecting the membrane to a plastics membrane supporting plate and FIG. 5 shows an enlarged partial sectional view of the rim region of a membrane fastened to a membrane supporting plate.

The apparatus 100 represented in FIG. 4 serves to connect the membrane 22 to the membrane supporting plate 10. The apparatus 100 includes a fixed, matrix-like bottom part 34 and a top part 36 which can be advanced in the axial direction thereof onto the bottom part 34. The mutually facing end faces 38, 40 of the bottom part 34 and of the top part 36 respectively, are matched at least approximately to the shape of the finished membrane arrangement 10, 22. The top part 36 additionally includes, on the end face 40, an annular beading surface 42, which is designed for beading and is directed obliquely outward. This beading surface 42 serves to deform the annular beaded rim 32 of the membrane supporting plate 10.

In FIG. 5, the rim region of the finished membrane arrangement 10, 22 is shown enlarged, in section. In this case, the beaded rim 32 extending, prior to assembly, in the axial direction (FIGS. 3 and 4), is deformed such that it now, as represented at 32', extends at least approximately radially outwards. As a result of this deformation, the membrane 22 is connected by its inner clamping boss 28, free from distortion, to the membrane supporting plate 10. The connection is pressure-tight since the inner clamping boss 28, as well as the other part of the membrane 22, is made from a highly elastic material, such as from two-component liquid silicones, for example. The membrane supporting plate 10 preferably consists of a plastic, such as a polycarbonate, for example.

As shown in FIG. 4, in the bottom part 34, on the end face 38, there are disposed openings 43, which are connected via channels 44 to a vacuum source (not shown) of known construction. As a result of these openings 43, the membrane 22 is secured by means of a vacuum after the membrane supporting plate 10 and then the membrane 22 have previously been placed onto the bottom part 34. The vacuum acts upon the crimp 26 of the membrane 22 in order to draw the membrane reliably, by its inner clamping boss 28, into the ring groove 30 of the membrane supporting plate 10.

Once the membrane supporting plate 10 and the membrane 22 have been inserted into the apparatus and the vacuum source switched on, the top part 36 is advanced in the direction of arrow 46. At a predetermined contact pressure, the top part 36 is excited in the axial direction by means of vibrations in the ultrasonic range. As a result of the effect of the vibrations at the predetermined contact pressure, the beaded rim 32 is beaded by the beading surface 42.

The frequency of the ultrasonic vibrations at which a sonotrode 48, acting as the top part 36, is excited amounts generally to 20 or 40 kHz. Under the effect of the vibrations and heat, a flux is generated in the top part 36, which serves to create the deformation, in the present case, the beading of rim 32.

The generation of the ultrasonic vibrations is effected by an ultrasonic generator (not shown) of known construction, the electrical output of which is converted into mechanical vibrations by means of a converter (likewise not shown). These vibrations are transmitted via a booster 50 to the sonotrode 48. The booster 50 influences the amplitude in order to transform it to the value required at the sonotrode 48.

By virtue of the invention, the reliable anchorage of an annular membrane made from highly elastic material on a membrane supporting plate is ensured. The invention is especially suitable for the pressure-tight connection of two different materials which cannot be glued or welded together.

What is claimed is:

1. A pressure responsive membrane arrangement comprising:

an annular membrane supporting plate having a beaded rim, and a groove, and an annular membrane including an inner rim, said inner rim engaging the groove of the membrane supporting plate, said beaded rim contacting said inner rim so that the membrane is fastened in a distortion-free manner to the supporting plate so as to ensure a pressure-tight connection between the membrane and the supporting plate, said groove being an axially directed ring groove, said inner rim including a clamping boss which engages the ring groove.

2. The membrane arrangement as claimed in claim 1, wherein the beaded rim at least approximately seals the groove and is beaded radially outwards, thereby clamping the clamping boss in the ring groove.

3. The membrane arrangement as claimed in claim 1, wherein the membrane supporting plate includes a hub and a ram disposed at a center thereof, and reinforcing ribs extending radially from one of the hub and the ram.

4. A pressure responsive membrane arrangement comprising:

an annular membrane supporting plate having a beaded rim, and a groove, and an annular membrane including an inner rim, said inner rim engaging the groove of the membrane supporting plate, said beaded rim being generally J-shaped in an undeformed state and having a portion which is constructed and arranged to deform thereby clamping a portion of the membrane against said inner rim so that said membrane is fastened in a distortion free manner to the supporting plate thereby ensuring a pressure-tight connection between the membrane and the supporting plate.

* * * * *